US009643331B2

(12) United States Patent
Hsu

(10) Patent No.: US 9,643,331 B2
(45) Date of Patent: May 9, 2017

(54) ADJUSTING STRUCTURE FOR CURTAIN CUTTING MACHINE

(71) Applicant: Chin-Fa Lin, New Taipei (TW)

(72) Inventor: Hao-Yu Hsu, New Taipei (TW)

(73) Assignee: Chin-Fa Lin, New Taipei (TW)

( * ) Notice: Subject to any disclaimer, the term of this patent is extended or adjusted under 35 U.S.C. 154(b) by 110 days.

(21) Appl. No.: 14/804,664

(22) Filed: Jul. 21, 2015

(65) Prior Publication Data

US 2017/0021517 A1 Jan. 26, 2017

(51) Int. Cl.
*B26D 7/01* (2006.01)
*B26D 7/06* (2006.01)
*B26D 1/04* (2006.01)

(52) U.S. Cl.
CPC ..... *B26D 7/01* (2013.01); *B26D 1/04* (2013.01); *B26D 7/0683* (2013.01)

(58) Field of Classification Search
CPC ..... B26D 7/01; B26D 7/0683; B26D 1/04
USPC ..... 83/196–198, 569
See application file for complete search history.

(56) References Cited

U.S. PATENT DOCUMENTS 3,972,257 A * 8/1976 Lazar, Jr. ..... B23D 15/14 83/198
6,178,857 B1 * 1/2001 Marocco ..... B23D 23/00 29/24.5
6,305,259 B1 * 10/2001 Whitworth ..... B23D 45/046 83/113
6,435,066 B1 * 8/2002 Kutchmarek ..... B23D 23/00 29/24.5
6,758,120 B2 * 7/2004 Marocco ..... B23D 23/00 29/24.5
7,059,230 B2 * 6/2006 Caputo ..... B23D 23/00 83/198
7,107,889 B2 * 9/2006 Marocco ..... B23D 23/00 29/24.5
7,752,724 B2 * 7/2010 Kollman ..... B23D 23/00 29/24.5
7,895,928 B2 * 3/2011 Maloney ..... B23D 15/005 83/112
7,987,752 B2 * 8/2011 Tsung ..... B23D 59/02 125/15
8,336,434 B2 * 12/2012 Sandberg ..... A22C 17/0093 426/518
8,720,313 B2 * 5/2014 Kollman ..... B23D 23/00 83/196

(Continued)

*Primary Examiner* — Sean Michalski
(74) *Attorney, Agent, or Firm* — Alan D. Kamrath; Kamrath IP Lawfirm, P.A.

(57) ABSTRACT

An adjusting structure for a curtain cutting machine, wherein the curtain cutting machine is adapted to cut a curtain which contains a first rail, a second rail, and a plurality of curtain blinds. The curtain cutting machine contains: an elongated base and an adjustment mechanism. The adjustment mechanism contains: a fixing plate including a first orifice and a second orifice; at least one slidable rod being forced to slide in a first sliding travel; a driving unit for driving the at least one slidable rod to slide in a second sliding travel; a first cutting unit corresponding to the second orifice; a second cutting unit driven by the at least one slidable rod to slide; and a third cutting unit including a holder and a third cutter. The holder is coupled with the first orifice, and the third cutter is disposed on the at least one slidable rod.

7 Claims, 16 Drawing Sheets

(56) References Cited

U.S. PATENT DOCUMENTS

| | | | | |
|---|---|---|---|---|
| 8,910,553 | B2 * | 12/2014 | Catelli | B26D 1/46 83/418 |
| 8,950,303 | B2 * | 2/2015 | Tsai | B26D 7/0625 83/112 |
| 2002/0178884 | A1 * | 12/2002 | Chuang | B23D 45/10 83/24 |
| 2003/0066403 | A1 * | 4/2003 | Lin | B23D 23/00 83/412 |
| 2003/0110913 | A1 * | 6/2003 | Lin | B23D 23/00 83/454 |
| 2005/0150337 | A1 * | 7/2005 | Cheng | B23D 17/08 82/101 |
| 2005/0150344 | A1 * | 7/2005 | Nien | B26D 5/08 83/651 |
| 2005/0188515 | A1 * | 9/2005 | Reimer | B23D 33/08 29/24.5 |
| 2008/0115646 | A1 * | 5/2008 | Simokovic | B23D 23/00 83/588 |

* cited by examiner

ADJUSTING STRUCTURE FOR CURTAIN CUTTING MACHINE

BACKGROUND OF THE INVENTION

Field of the Invention

The present invention relates to a curtain cutting machine, and more particularly to an adjusting structure for a curtain cutting machine which moves a plurality of curtain blinds close to one another to cut the plurality of curtain blinds easily.

Description of the Prior Art

A conventional curtain is employed to shield or decorate a window in a building, wherein a blind curtain is most popular and contains a first rail, a second rail, and plural blinds. As producing the blind curtain in various sizes (i.e., widths of the first rail, the second rail, and the plural blinds are different to form widths of a plurality of blind curtains), hence a curtain cutting machine cuts and trims a variety of curtains at desired widths for decoration and light shielding effect.

The curtain is included of a first rail, a second rail, and plural blinds which are elongated. To cut the plural blinds of the curtain flatly, the plural blinds are moved close to one another. In case the plural blinds are not moved close to one another, they will be cut roughly to cause different lengths and uneven rims. Furthermore, a control rope is inserted among the first rail, the second rail, and the plural blinds to separate the first rail, the second rail, and the plural blinds at a limited distance. As cutting the conventional curtain, a positioning block is fixed among the plural blinds to move the plural blinds close to one another. However, fixing the positioning block among the plural blinds is troublesome and time-consuming at a high labor cost. Moreover, the plural blinds are damaged as being cut roughly.

The present invention has arisen to mitigate and/or obviate the afore-described disadvantages.

SUMMARY OF THE INVENTION

The primary objective of the present invention is to provide an adjusting structure for a curtain cutting machine which moves a plurality of curtain blinds of a curtain close to one another, thus cutting the curtain easily and efficiently at a low labor cost. Preferably, the curtain is cut flatly to enhance its quality and reduce cutting damage.

Accordingly, an adjusting structure for a curtain cutting machine provided by the present invention curtain cutting machine is adapted to cut a curtain, and the curtain contains a first rail, a second rail, and a plurality of curtain blinds. The curtain cutting machine contains:

a base being an elongated platform; and an adjustment mechanism mounted on the base and including: a fixing plate, at least one slidable rod, a driving unit, a first cutting unit, a second cutting unit, and a third cutting unit.

The fixing plate is rectangular and includes a first orifice defined thereon to insert the plurality of curtain blinds, and the fixing plate also includes a second orifice defined on one end of the first orifice.

The at least one slidable rod is slidably disposed on the fixing plate and is forced to slide in a first sliding travel.

The driving unit is connected with the at least one slidable rod to drive the at least one slidable rod to slide in a second sliding travel.

The first cutting unit is fixed on the fixing plate and corresponds to the second orifice.

The second cutting unit is movable and is disposed in the fixing plate, wherein the second cutting unit is driven by the at least one slidable rod to slide in a predetermined range.

The third cutting unit includes a holder and a third cutter, wherein the holder is coupled with the one end of the first orifice, and the third cutter is disposed on the at least one slidable rod, such that the third cutter and the second cutting unit slide with the at least one slidable rod in the first sliding travel, the plurality of curtain blinds move close to one another, and the third cutter slides with the at least one slidable rod in the second slidable travel to cut the plurality of curtain blinds relative to the holder.

DETAILED DESCRIPTION OF THE PREFERRED EMBODIMENTS

Figure 1:
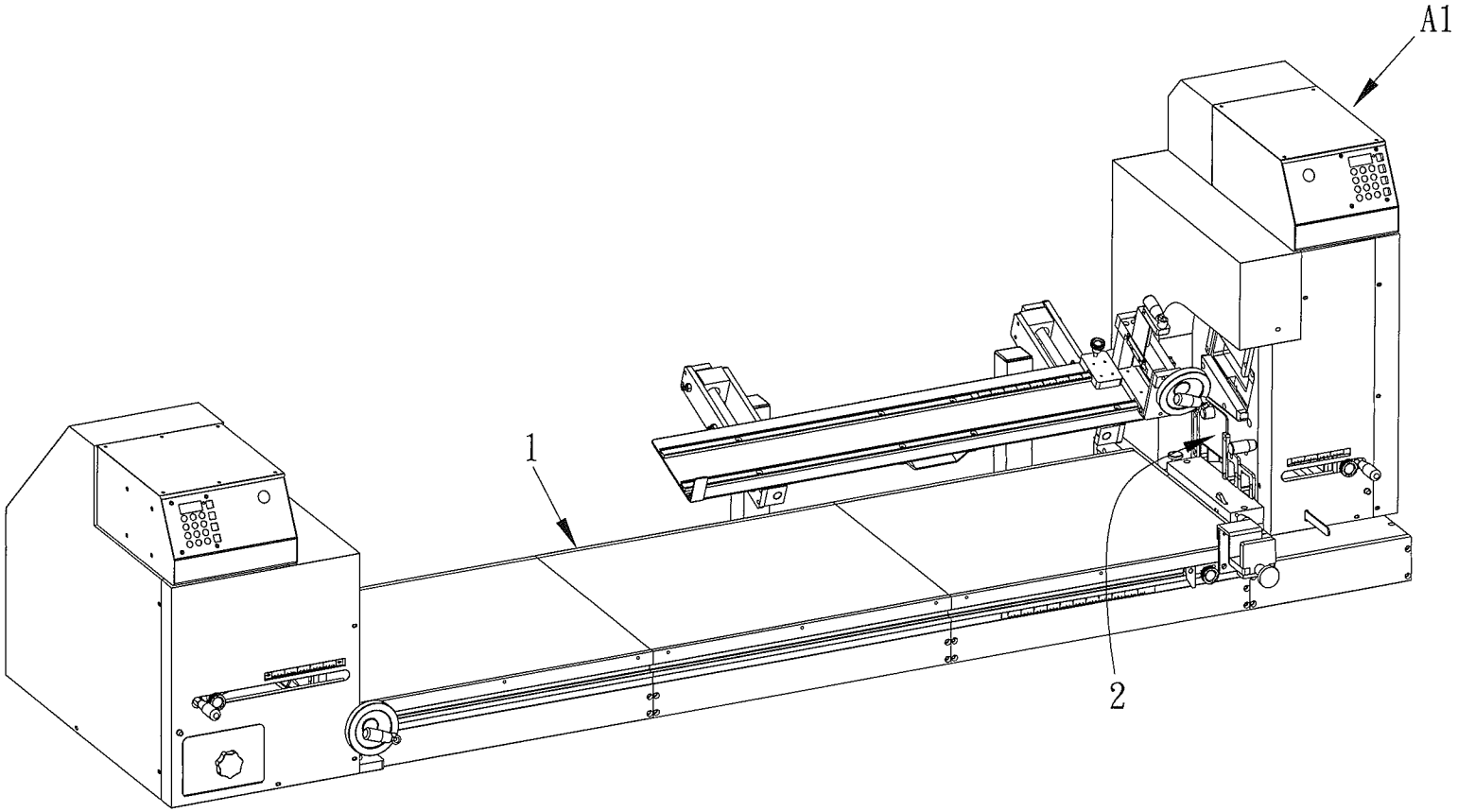
FIG. 1 is a perspective view showing the assembly of a curtain cutting machine in accordance with a preferred embodiment of the present invention.
Figure 2:
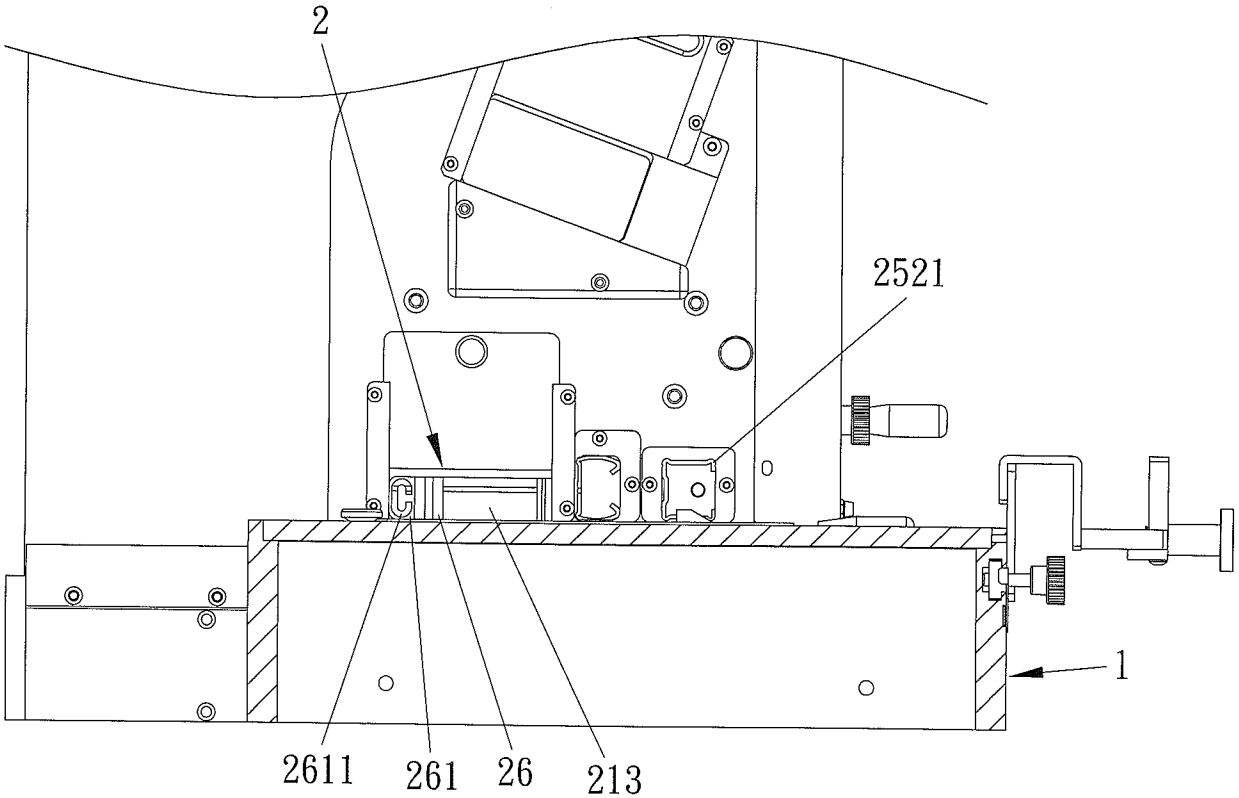
FIG. 2 is a side plane view showing the assembly of a part of the curtain cutting machine in accordance with the preferred embodiment of the present invention.
Figure 3:
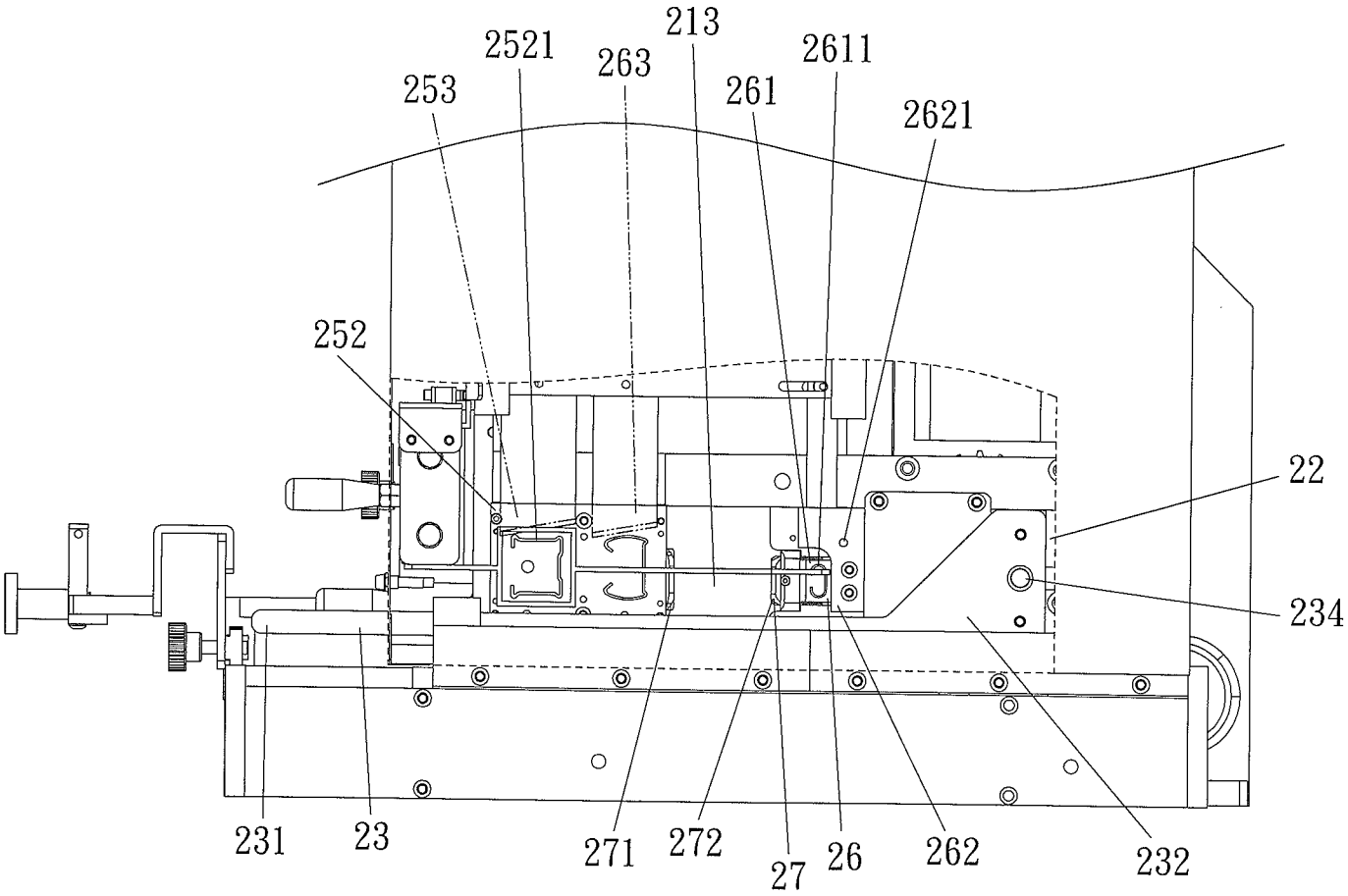
FIG. 3 is another side plane view showing the assembly of a part of the curtain cutting machine in accordance with the preferred embodiment of the present invention.
Figure 4:
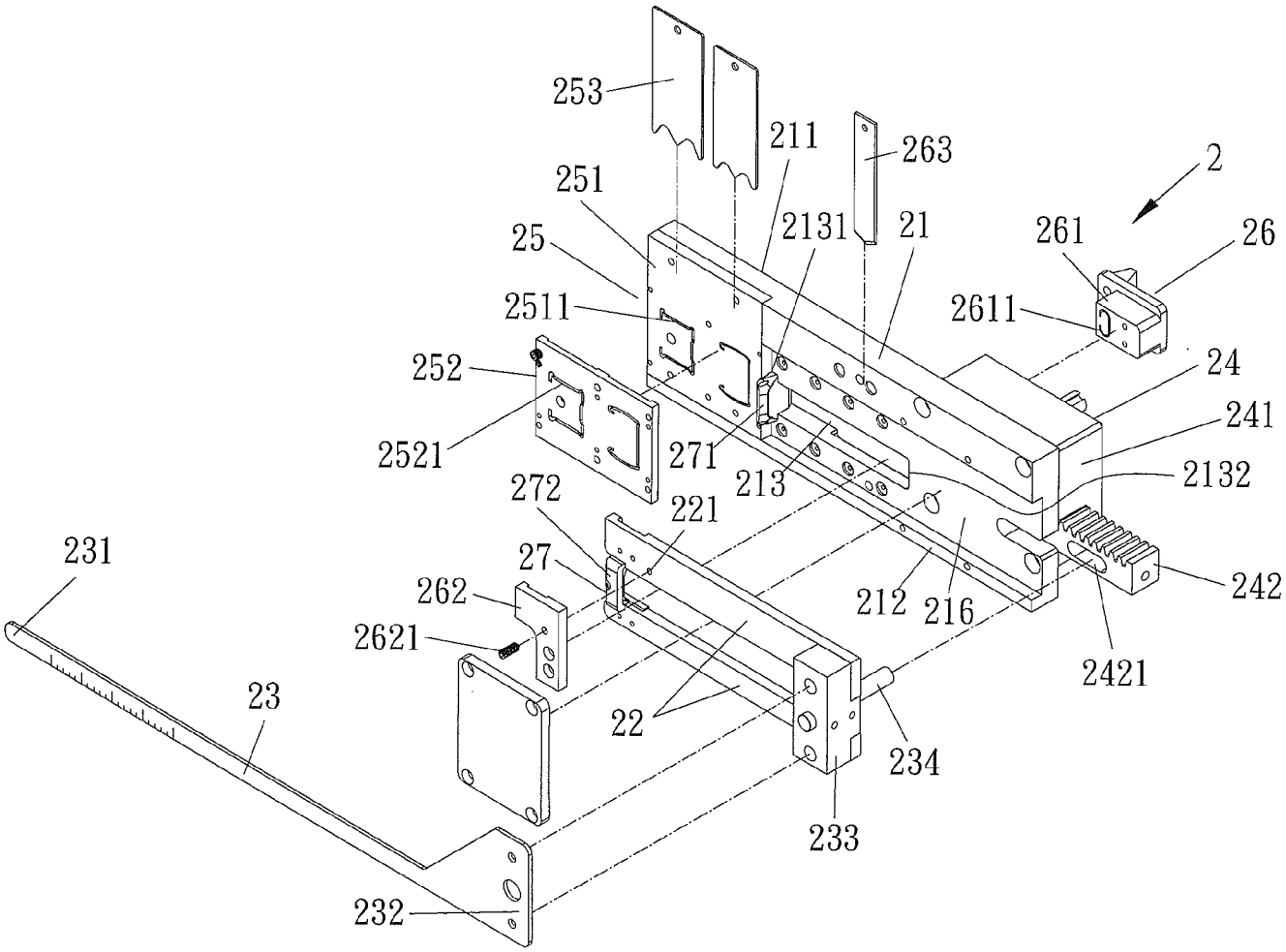
FIG. 4 is a perspective view showing the exploded components of an adjusting structure for a curtain cutting machine in accordance with the preferred embodiment of the present invention.
Figure 5:
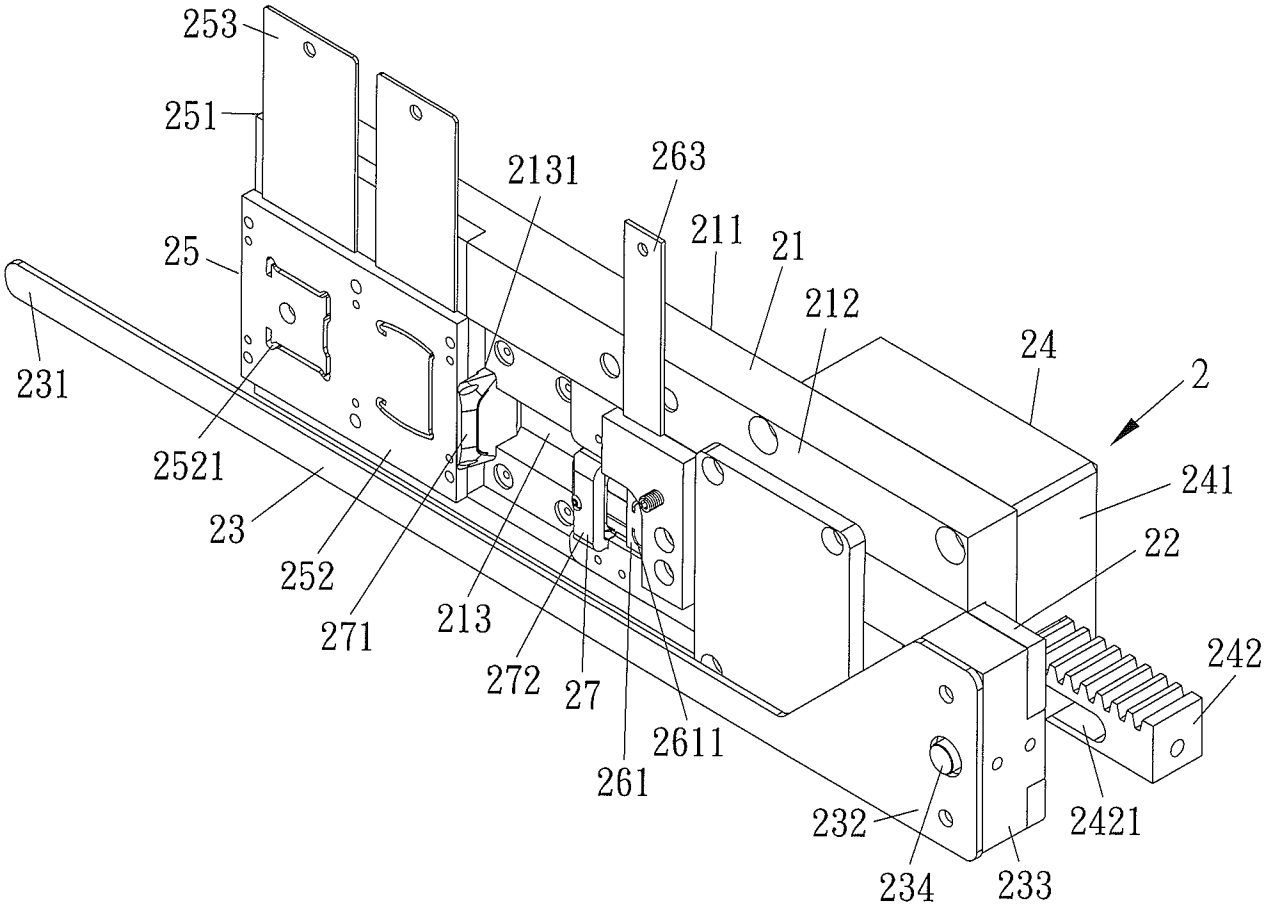
FIG. 5 is a perspective view showing the assembly of the adjusting structure for the curtain cutting machine in accordance with the preferred embodiment of the present invention.
Figure 6:
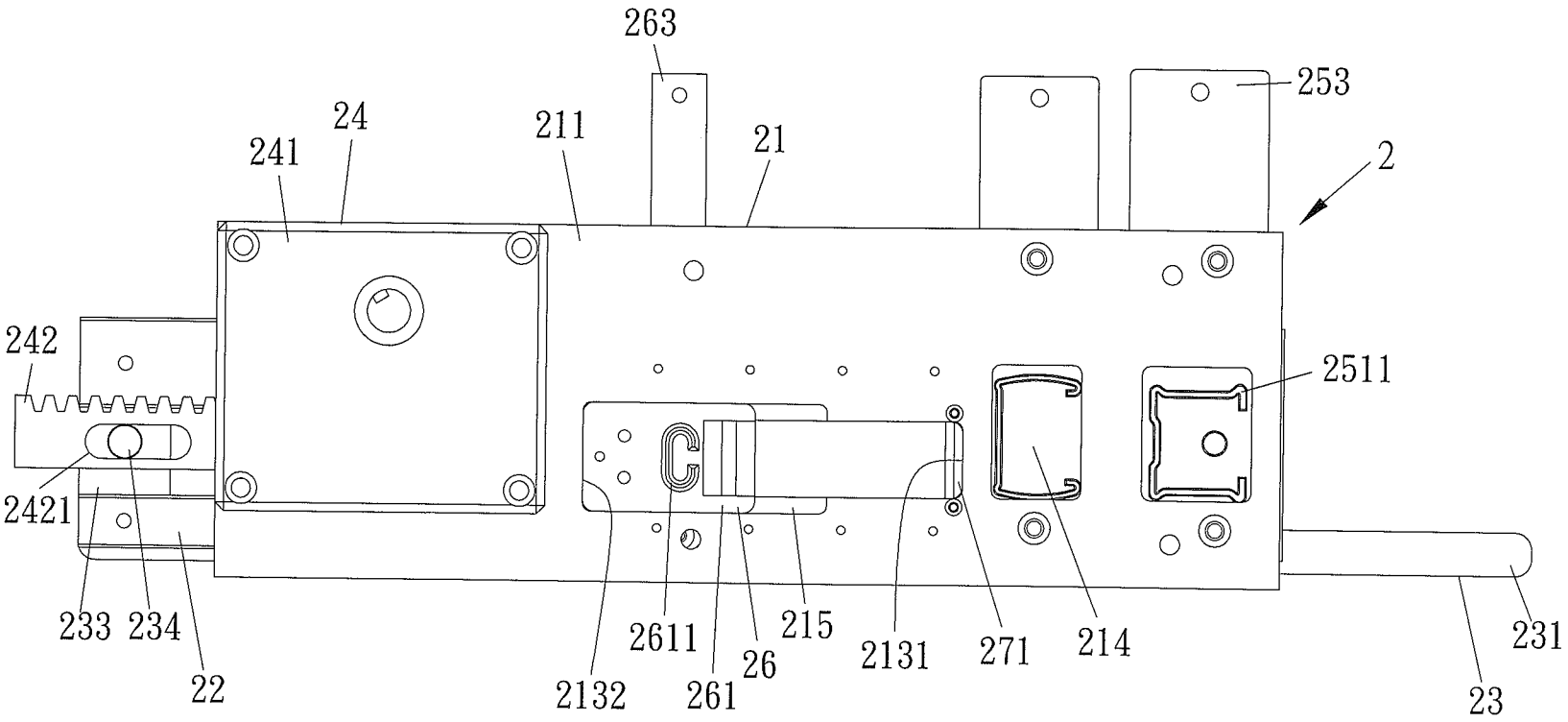
FIG. 6 is a side plane view showing the assembly of the adjusting structure for the curtain cutting machine in accordance with the preferred embodiment of the present invention.
Figure 7:
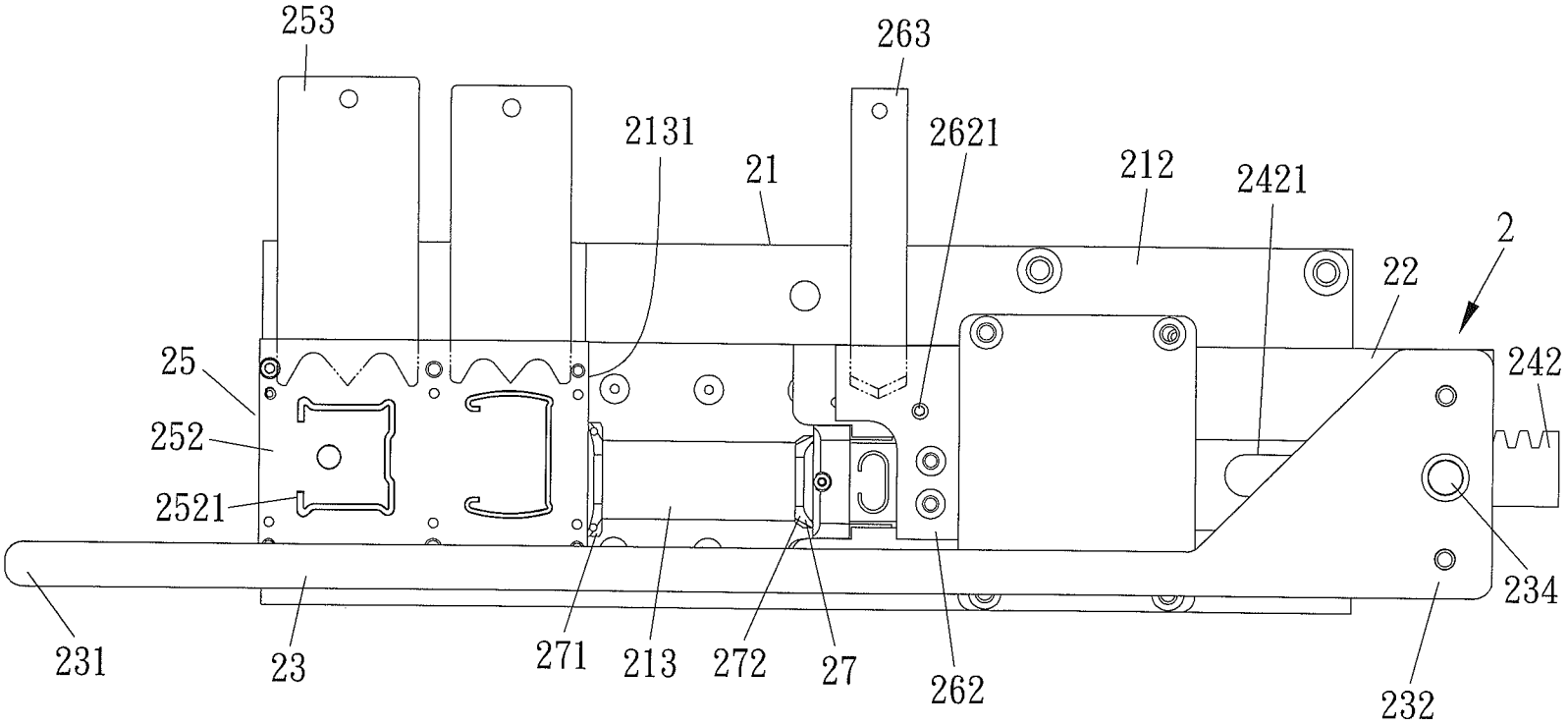
FIG. 7 is another side plane view showing the assembly of the adjusting structure for the curtain cutting machine in accordance with the preferred embodiment of the present invention.

The present invention will be clearer from the following description when viewed together with the accompanying drawings, which show, for purpose of illustrations only, the preferred embodiment in accordance with the present invention.

With reference to FIGS. 1 to 9, an adjusting structure for a curtain cutting machine according to a preferred embodiment of the present invention, wherein the curtain cutting machine A1 is adapted to cut a curtain A2, and the curtain A2 contains a first rail A21, a second rail A22, and a plurality of curtain blinds A23. The curtain cutting machine A1 includes: a base 1 and an adjustment mechanism 2, wherein the base 1 is an elongated platform, and the adjustment mechanism 2 is mounted on the base 1. The adjustment mechanism 2 includes a fixing plate 21, two slidable rods 22, a pulling unit 23, a driving unit 24, a first cutting unit 25, a second cutting unit 26, and a third cutting unit 27.

The fixing plate 21 is rectangular and includes a first face 211, a second face 212 opposite to the first face 211, a first orifice 213 defined thereon, and a second orifice 214 defined on one end of the first orifice 213, wherein the first orifice 213 has a first segment 2131 and a second segment 2132 opposite to the first segment 2131. The fixing plate 21 further includes a first groove 215 formed on the first face 211 and includes a second groove 216 arranged on the second face 212.

The two slidable rods 22 are slidably disposed in the second groove 216 of the second face 212 of the fixing plate 21 and includes a locking slot 221 formed thereon, wherein the two slidable rods 22 are forced to slide in a first sliding travel.

The pulling unit 23 includes a pull segment 231 and a connecting segment 232 with respect to the pull segment 231, and the pull segment 231 extends outwardly from the adjustment mechanism 2. The connecting segment 232 is in connection with the two slidable rods 22 through a connector 233, such that the two slidable rods 22 are forced to slide in the first sliding travel and they are driven by the pulling unit 23 to slide in the first sliding travel. The connector 233 is joined with a driven stem 234.

The driving unit 24 is mounted on the first face 211 of the fixing plate 21 and includes a drive mechanism 241 and a toothed rack 242 driven by the drive mechanism 241 to move, wherein the toothed rack 242 has an elongated orifice 2421 for inserting the driven stem 234, such that the two slidable rods 22 slide freely in the elongated orifice 2421, and the toothed rack 242 drives the two slidable rods 22 to slide in a second sliding travel from the elongated orifice 2421.

The first cutting unit 25 is fixed on the fixing plate 21 and corresponds to the second orifice 214, and the first cutting unit 25 has a mount 251, a first guiding piece 252, and two first cutters 253. The mount 251 contacts with the first guiding piece 252 and has a first aperture 2511 communicating with the second orifice 214, and the first guiding piece 252 has a second aperture 2521 corresponding to the first aperture 2511 and communicating with the second orifice 214, wherein the two first cutters 253 are slidably secured between the mount 251 and the first guiding piece 252 and align with the first aperture 2511 and the second aperture 2521.

The second cutting unit 26 is movable and includes a sliding seat 261, a second guiding piece 262, and a second cutter 263. The sliding seat 261 is disposed in the first groove 215 and the first orifice 213 of the fixing plate 21 from the first face 211 of the fixing plate 21, and the sliding seat 261 has a second aperture 2611, wherein the second guiding piece 262 contacts with the sliding seat 261 from the second face 212 of the fixing plate 21, the second cutter 263 is slidably mounted between the sliding seat 261 and the second guiding piece 262 and aligns with the second aperture 2611, and the second guiding piece 262 has a locking element 2621 fixed thereon and locked in the locking slot 221 of the two slidable rods 22, such that the second cutting unit 26 slides with the two slidable rods 22, and the locking element 2621 unlocks from the locking slot 221 of the two slidable rods 22, when the second cutting unit 26 is stopped.

The third cutting unit 27 includes a holder 271 and a third cutter 272, wherein the holder 271 is coupled with the first segment 2131 of the first orifice 213, and the third cutter 272 is disposed on the two slidable rods 22, such that the third cutter 272 slides and cuts the plurality of curtain blinds A23 relative to the holder 271, when the two slidable rods 22 slide.

Figure 8:
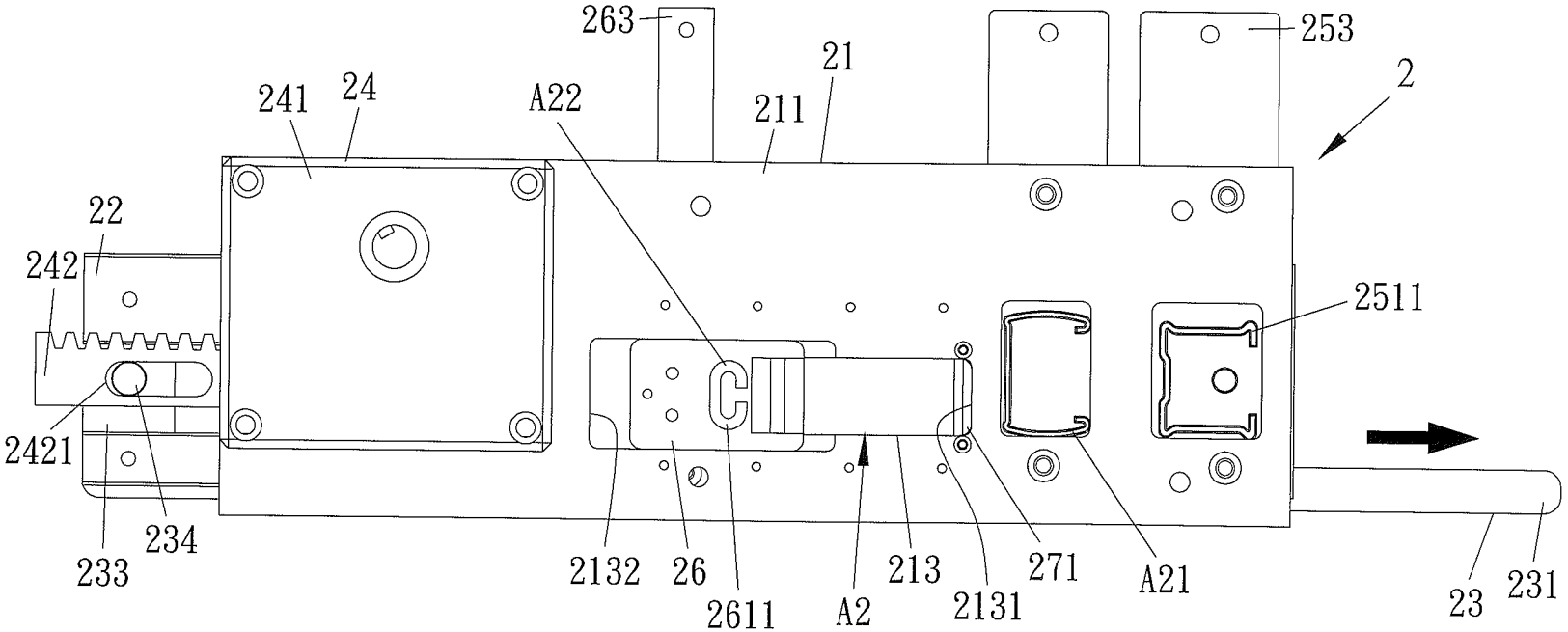
FIG. 8 is also another side plane view showing the operation of the adjusting structure for the curtain cutting machine in accordance with the preferred embodiment of the present invention.
Figure 9:
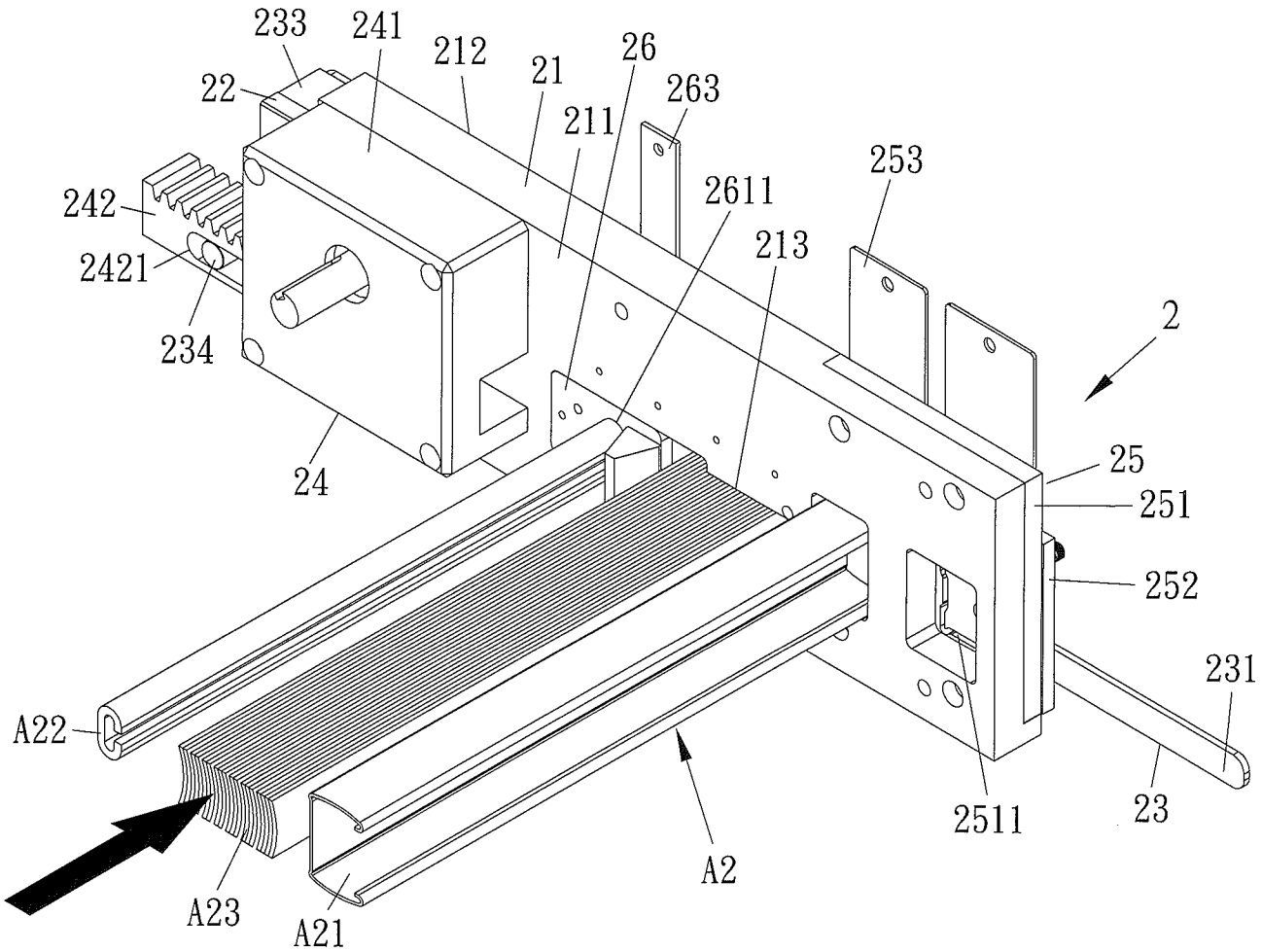
FIG. 9 is a perspective view showing the operation of the adjusting structure for the curtain cutting machine in accordance with the preferred embodiment of the present invention.
Figure 10:
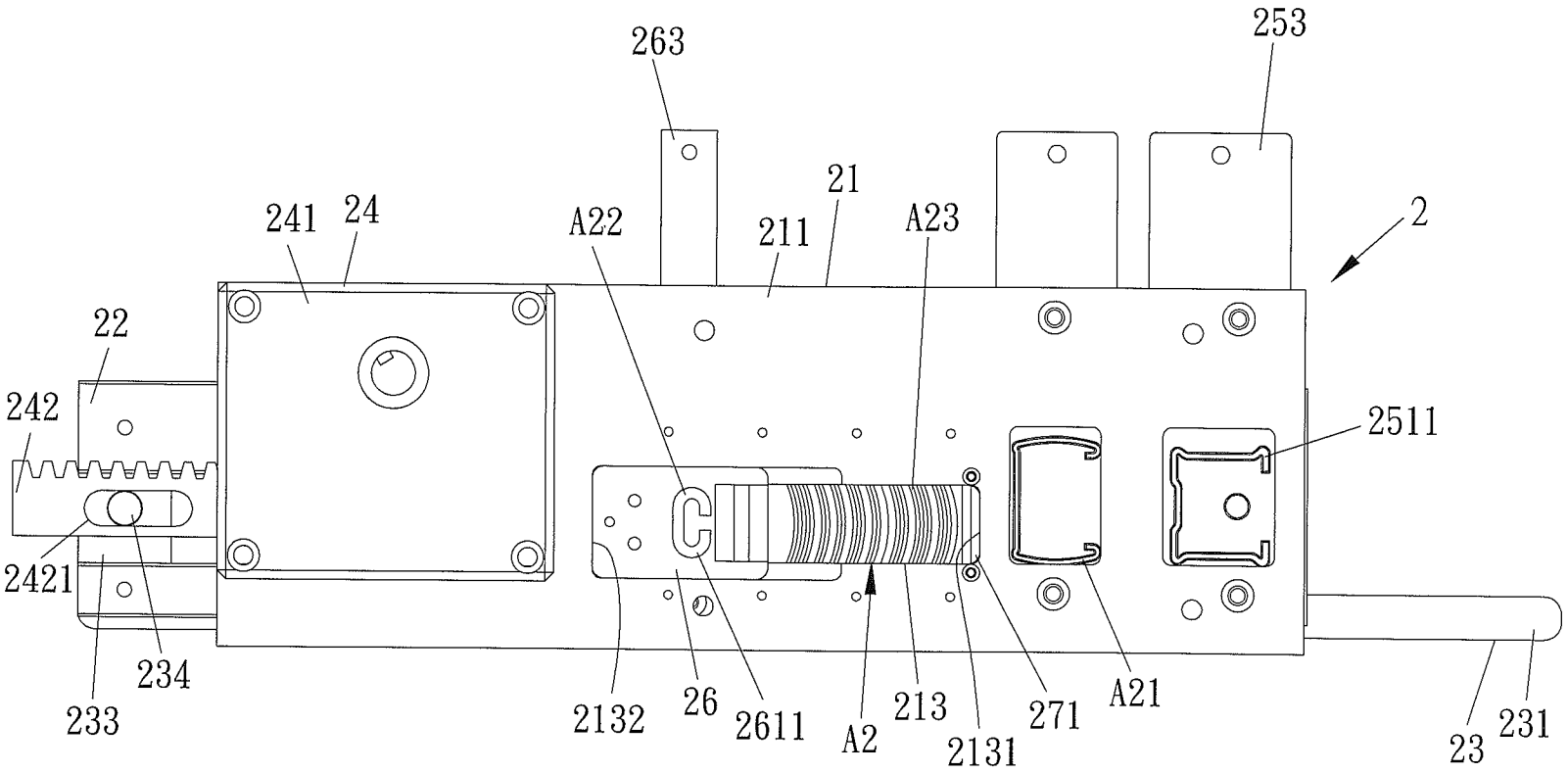
FIG. 10 is still another side plane view showing the operation of the adjusting structure for the curtain cutting machine in accordance with the preferred embodiment of the present invention.
Figure 11:
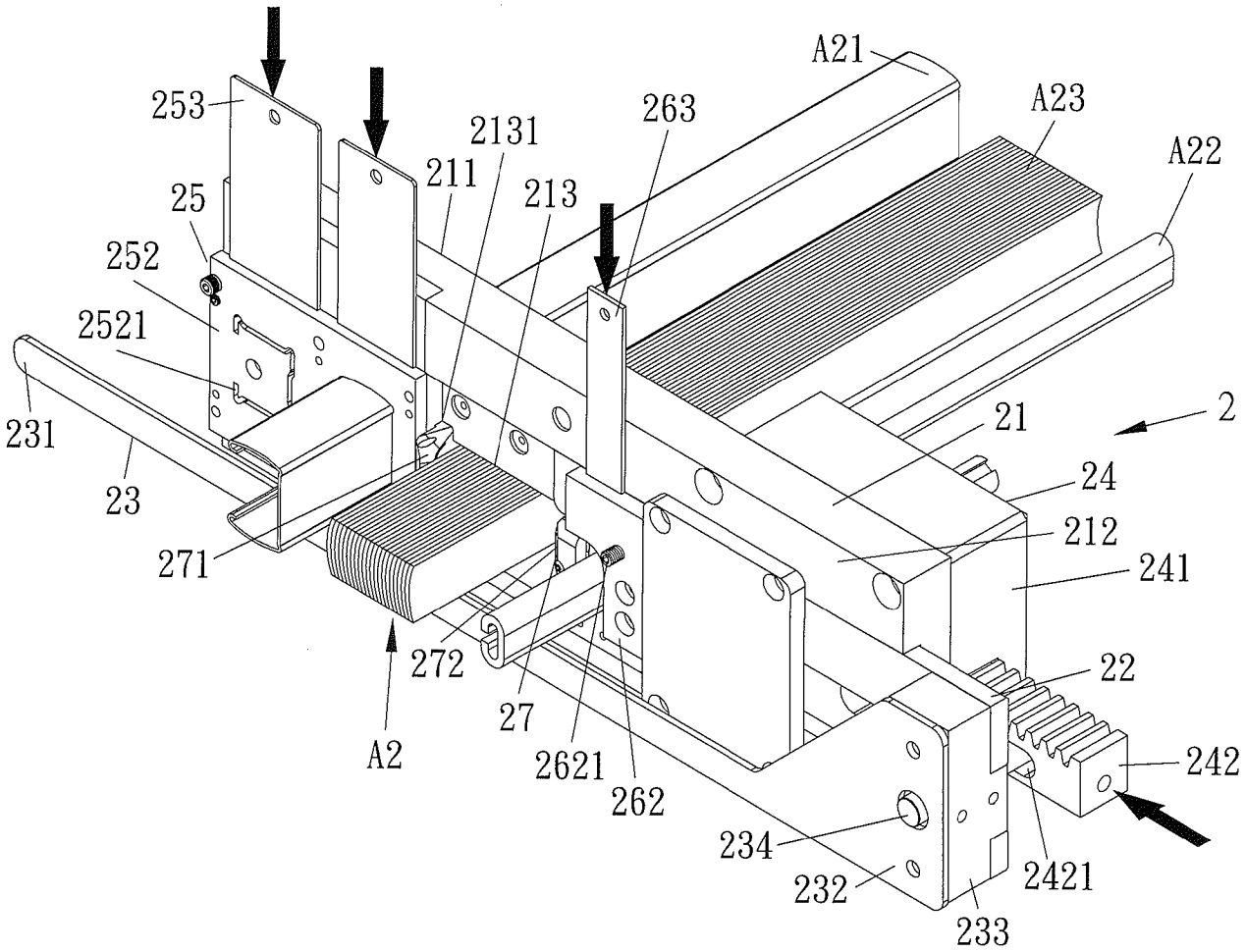
FIG. 11 is another perspective view showing the operation of the adjusting structure for the curtain cutting machine in accordance with the preferred embodiment of the present invention.
Figure 12:
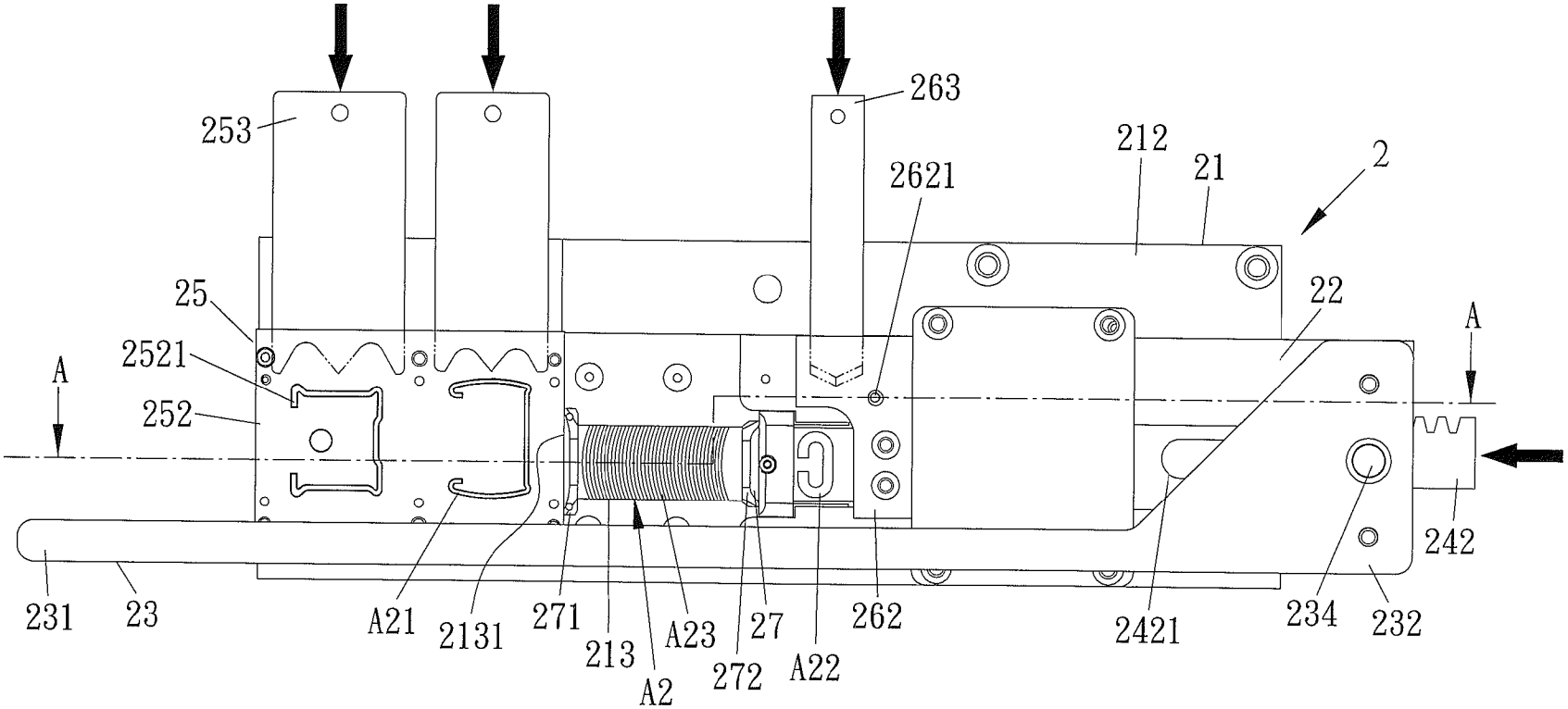
FIG. 12 is another side plane view showing the operation of the adjusting structure for the curtain cutting machine in accordance with the preferred embodiment of the present invention.
Figure 13:
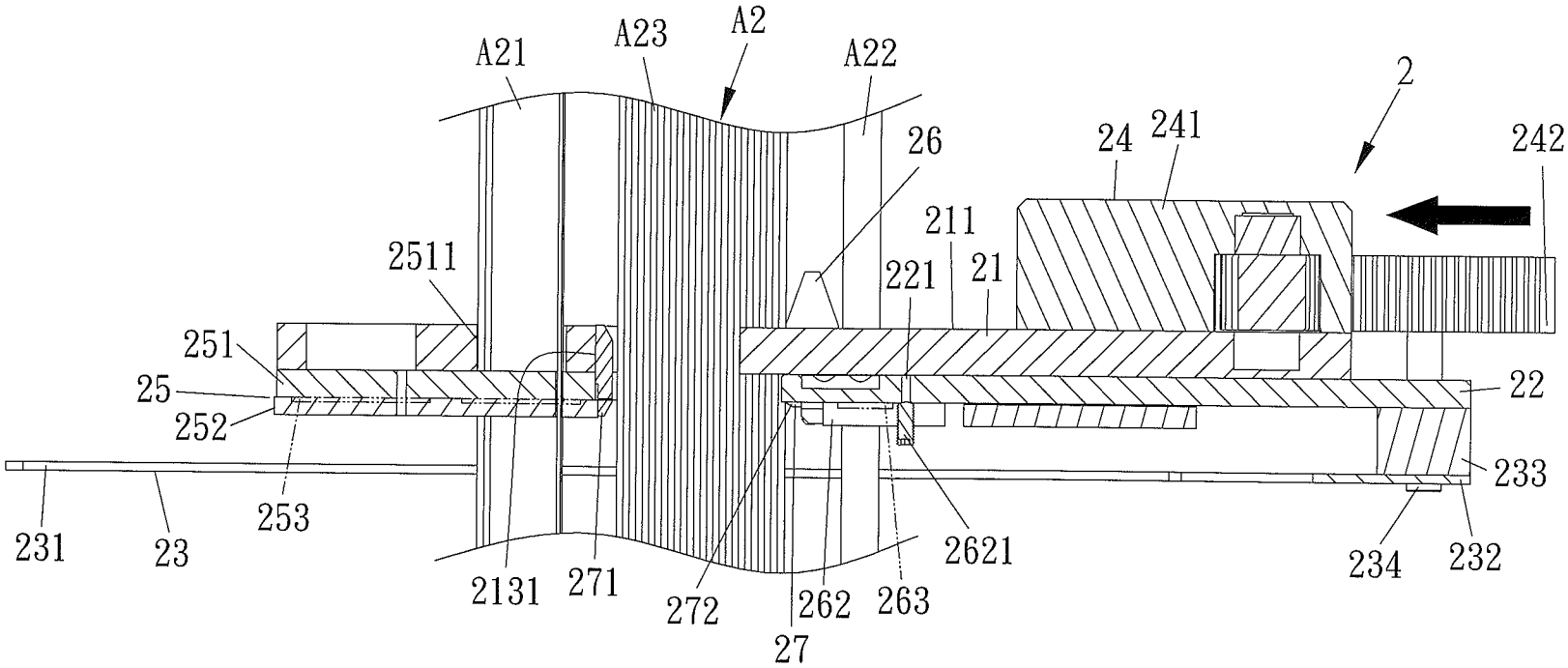
FIG. 13 is a cross sectional view taken along the line A-A of FIG. 12.
Figure 14:
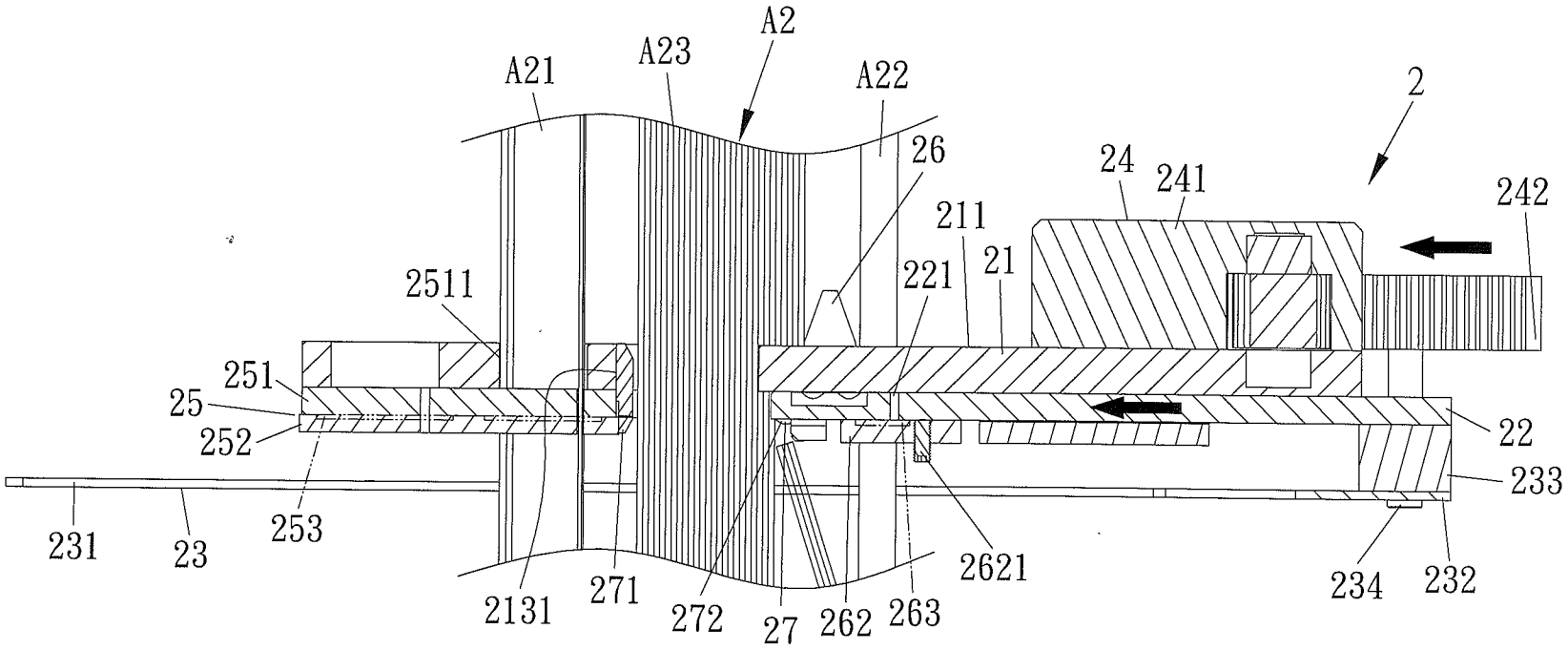
FIG. 14 is a cross sectional view showing the operation of the adjusting structure for the curtain cutting machine in accordance with the preferred embodiment of the present invention.
Figure 15:
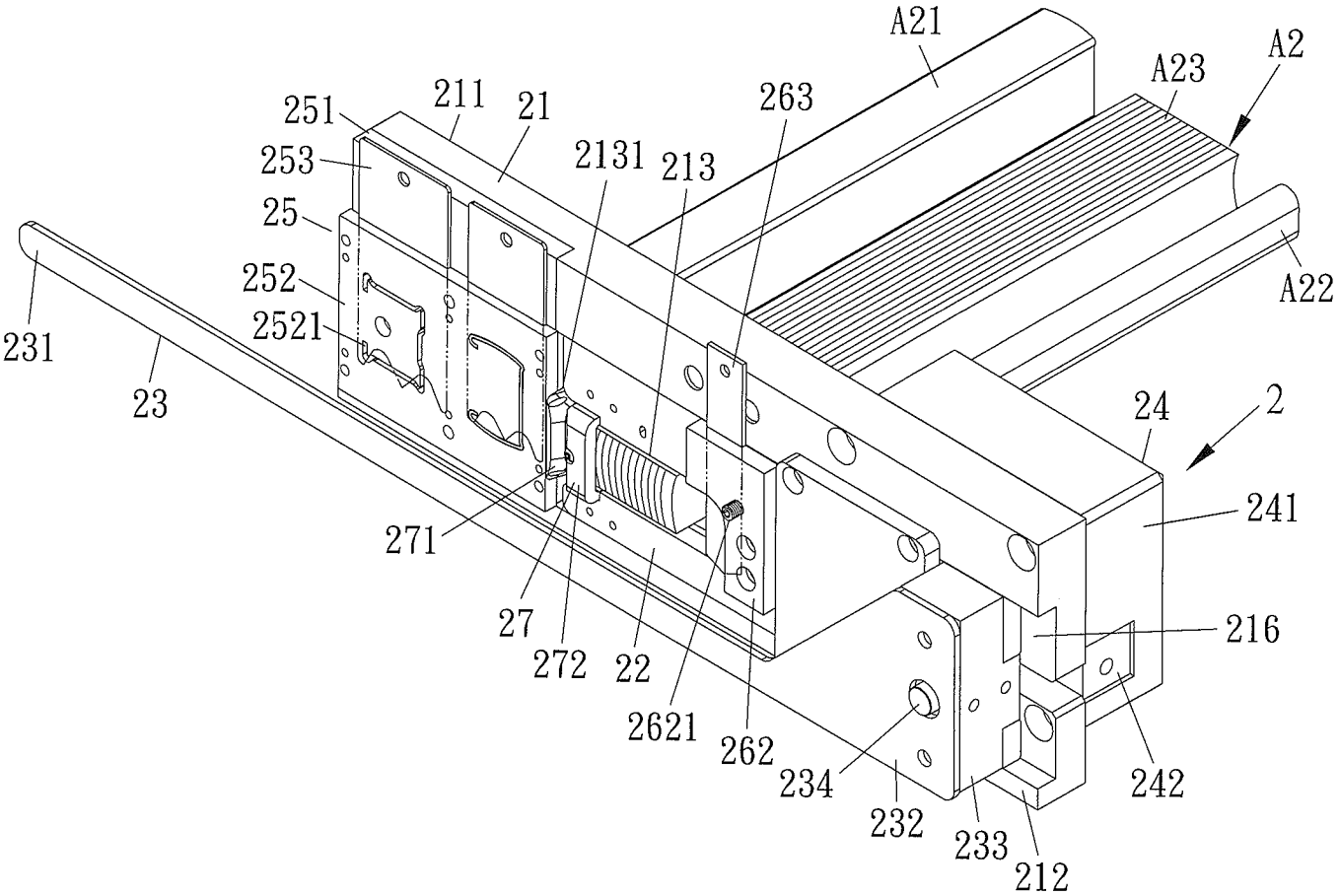
FIG. 15 is also another side plane view showing the operation of the adjusting structure for the curtain cutting machine in accordance with the preferred embodiment of the present invention.
Figure 16:
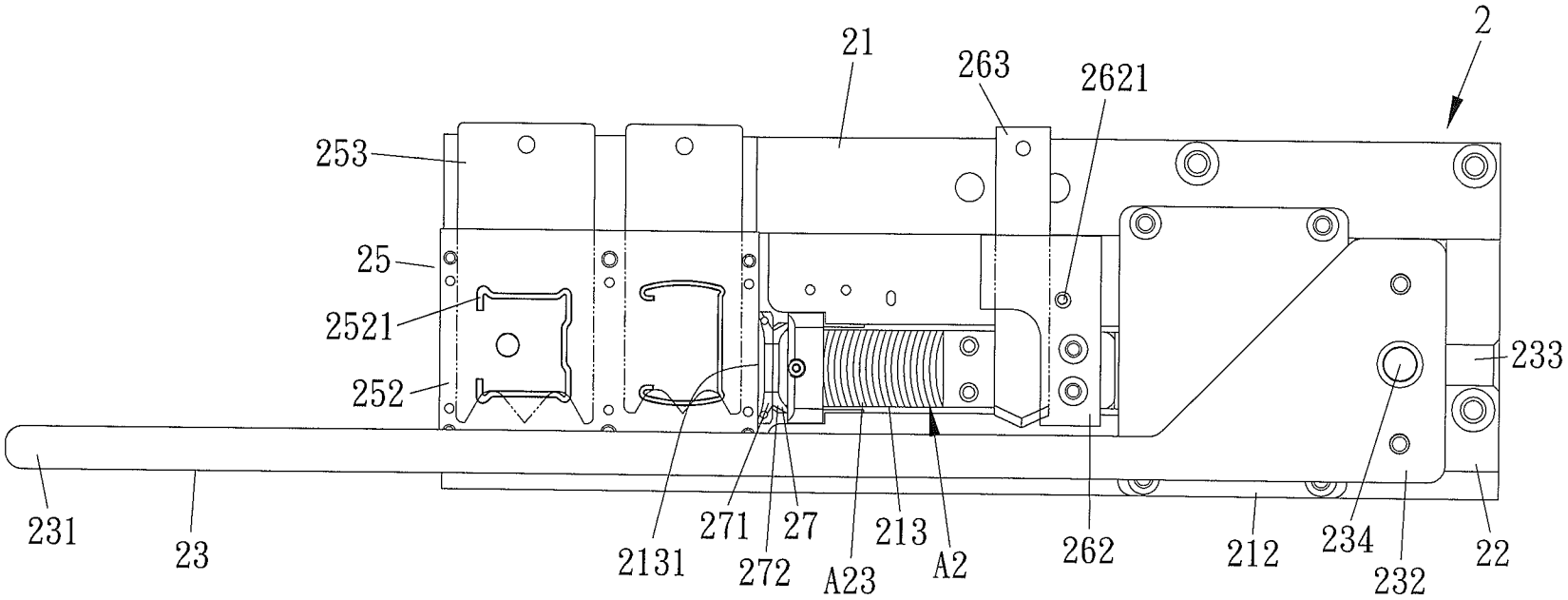
FIG. 16 is still another side plane view showing the operation of the adjusting structure for the curtain cutting machine in accordance with the preferred embodiment of the present invention

Referring to FIGS. 8 to 10, when the two slidable rods 22 are exerted a force to slide or are pulled by the pull segment 231 of the pulling unit 23, the driven stem 234 of the pulling unit 23 slides randomly in the elongated orifice 2421 of the toothed rack 242 of the driving unit 24, and the locking element 2621 of the second cutting unit 26 locks in the locking slot 221 of the two slidable rods 22, so the third cutter 272 and the second cutting unit 26 slide in a first sliding travel with the two slidable rods 22, and a width of the first orifice 213 is diminished to insert the plurality of curtain blinds A23 of the curtain A2. Thereafter, the second aperture 2611 moves close to the first aperture 2511 and the second aperture 2521 so that the first rail A21, the second rail A22, and the plurality of curtain blinds A23 are inserted into and partially extend out of the first aperture 2511 and the second aperture 2521 of the adjustment mechanism 2, the second aperture 2611, and the first orifice 213. Hence, the plurality of curtain blinds A23 in the first orifice 213 move close to one another, a distance among the first rail A21, the second rail A22, and the plurality of curtain blinds A23 of the curtain A2 corresponds to a pulling range of a control rope. Thereafter, the driving unit 24 is started, as shown in FIGS. 11 to 16, wherein the drive mechanism 241 drives the toothed rack 242 to move solely, and then one end of the elongated orifice 2421 of the toothed rack 242 abuts against the driven stem 234 of the pulling unit 23 so that the toothed rack 242 drives the two slidable rods 22 to slide in the second sliding travel. When the second cutting unit 26 is stopped by the plurality of curtain blinds A23 or by an edge of the first groove 215, the locking element 2621 of the second cutting unit 26 unlocks from the locking slot 221 of the two slidable rods 22, such that the second cutting unit 26 is not actuated by the two slidable rods 22, and the third cutter 272 is driven by the two slidable rods 22 to slidably cut the plurality of curtain blinds A23 with respect to the holder 271. In addition, the two first cutters 253 of the first cutting unit 25 cut the first rail A21, and the second cutter 263 of the second cutting unit 26 cuts the second rail A22, thus cutting the curtain A2 completely.

After cutting the curtain A2, the two slidable rods 22, the pulling unit 23, the driving unit 24, the first cutting unit 25, the second cutting unit 26, and the third cutting unit 27 of the adjustment mechanism 2 move back to their original positions to prepare next cutting process.

Accordingly, the adjusting structure for the curtain cutting machine of the present invention has following advantages:

the third cutter 272 and the second cutting unit 26 slide in the first sliding travel with the two slidable rods 22 to move the plurality of the curtain blinds A23 in the first orifice 213 close to one another, and the distance among the first rail A21, the second rail A22, and the plurality of curtain blinds A23 of the curtain A2 correspond to the pulling range of the control rope, thus cutting the curtain A2 easily and efficiently at a low labor cost. Preferably, the curtain A2 is cut flatly to enhance its quality and reduce cutting damage.

While we have shown and described various embodiments in accordance with the present invention, it is clear to those skilled in the art that further embodiments may be made without departing from the scope of the present invention.

What is claimed is:

1. An adjusting structure for a curtain cutting machine, wherein the curtain cutting machine is adapted to cut a curtain, and the curtain contains a first rail, a second rail, and a plurality of curtain blinds, the curtain cutting machine includes:

a base being an elongated platform; and an adjustment mechanism mounted on the base and including:

a fixing plate being rectangular and including a first orifice defined thereon to insert the plurality of curtain blinds, and the fixing plate also including a second orifice defined on one end of the first orifice;

at least one slidable rod slidably disposed on the fixing plate and being forced to slide in a first sliding travel;

a driving unit connected with the at least one slidable rod to drive the at least one slidable rod to slide in a second sliding travel;

a first cutting unit fixed on the fixing plate and corresponding to the second orifice;

a second cutting unit being movable and disposed in the fixing plate, wherein the second cutting unit is driven by the at least one slidable rod to slide in a predetermined range; and a third cutting unit including a holder and a third cutter, wherein the holder is coupled with the one end of the first orifice, and the third cutter is disposed on the at least one slidable rod, such that the third cutter and the second cutting unit slide with the at least one slidable rod in the first sliding travel, the plurality of curtain blinds move close to one another, and the third cutter slides with the at least one slidable rod in the second slidable travel to cut the plurality of curtain blinds relative to the holder.

2. The adjusting structure for the curtain cutting machine as claimed in claim 1, wherein the fixing plate also includes a first face and a second face opposite to the first face, the fixing plate further includes a first groove formed on the first face to fix the second cutting unit and includes a second groove arranged on the second face to fix the at least one slidable rod.

3. The adjusting structure for the curtain cutting machine as claimed in claim 2, wherein the second cutting unit is movable and includes a sliding seat, a second guiding piece, and a second cutter; the sliding seat is disposed in the first groove and the first orifice of the fixing plate from the first face of the fixing plate, and the sliding seat has a second aperture, wherein the second guiding piece contacts with the sliding seat from the second face of the fixing plate, the second cutter is slidably mounted between the sliding seat and the second guiding piece and aligns with the second aperture.

4. The adjusting structure for the curtain cutting machine as claimed in claim 1, wherein the at least one slidable rod includes a locking slot formed thereon, and the second cutting unit has a locking element locked in the locking slot of the at least one slidable rod, such that the second cutting unit slides with the at least one slidable rod, and the locking element unlocks from the locking slot, when the second cutting unit is stopped.

5. The adjusting structure for the curtain cutting machine as claimed in claim 1, wherein the pulling unit includes a pull segment and a connecting segment with respect to the pull segment, and the connecting segment is in connection with the at least one slidable rod through a connector, such that the at least one slidable rod is forced to slide in the first sliding travel, and the connector is joined with a driven stem, wherein the driving unit includes a drive mechanism and a toothed rack driven by the drive mechanism to move, wherein the toothed rack has an elongated orifice for inserting the driven stem, such that the at least one slidable rod slides freely in the elongated orifice, and the toothed rack is driven by the elongated orifice to drive the at least one slidable rod to slide in the second sliding travel.

6. The adjusting structure for the curtain cutting machine as claimed in claim 1, wherein the first cutting unit is fixed on the fixing plate and has a first mount, a first guiding piece, and at least one first cutter; the mount contacts with the first guiding piece and has a first aperture communicating with the second orifice, and the first guiding piece has a second aperture corresponding to the first aperture and communicating with the second orifice, wherein the at least one first cutter is slidably secured between the mount and the first guiding piece and aligns with the first aperture and the second aperture.

7. The adjusting structure for the curtain cutting machine as claimed in claim 1, wherein the curtain cutting machine further includes a pulling unit connected with the at least one slidable rod to drive the at least one slidable rod to slide in the first sliding travel.

* * * * *